US009964919B2

(12) United States Patent
Martin

(10) Patent No.: US 9,964,919 B2
(45) Date of Patent: May 8, 2018

(54) SHIPPING CAP FOR DRUM ASSEMBLY

(71) Applicant: Static Control Components, Inc., Sanford, NC (US)

(72) Inventor: Jonathan W. Martin, Fayetteville, NC (US)

(73) Assignee: Static Control Components, Inc., Sanford, NC (US)

( * ) Notice: Subject to any disclaimer, the term of this patent is extended or adjusted under 35 U.S.C. 154(b) by 0 days. days.

(21) Appl. No.: 15/372,865

(22) Filed: Dec. 8, 2016

(65) Prior Publication Data

US 2017/0176915 A1 Jun. 22, 2017

Related U.S. Application Data

(60) Provisional application No. 62/269,354, filed on Dec. 18, 2015.

(51) Int. Cl.

| | |
|---|---|
| ***G03G 21/18*** | (2006.01) |
| ***G03G 15/08*** | (2006.01) |
| ***G03G 15/00*** | (2006.01) |
| ***B41J 2/01*** | (2006.01) |

(52) U.S. Cl.

CPC ..... *G03G 21/181* (2013.01); *B41J 2/01* (2013.01); *G03G 15/0894* (2013.01); *G03G 15/757* (2013.01); *G03G 21/1864* (2013.01); *G03G 2215/00987* (2013.01); *G03G 2221/1807* (2013.01)

(58) Field of Classification Search

CPC ..... G03G 15/0894; G03G 2215/00987; G03G 15/75; G03G 15/757; G03G 21/181; G03G 21/1857; G03G 21/186; G03G 21/1864; G03G 2221/1657; G03G 2221/1807

See application file for complete search history.

(56) References Cited

U.S. PATENT DOCUMENTS

| | | | | |
|---|---|---|---|---|
| 8,135,304 | B2 | 3/2012 | Abe et al. | |
| 8,644,733 | B2 | 2/2014 | Peng et al. | |
| 8,892,004 | B2 * | 11/2014 | Huck | G03G 21/1857 399/106 |
| 8,923,731 | B2 * | 12/2014 | Chino | G03G 21/1647 399/110 |
| 8,995,877 | B2 | 3/2015 | Itabashi | |
| 2006/0193654 | A1 * | 8/2006 | Kamimura | B65D 81/113 399/103 |
| 2008/0152388 | A1 * | 6/2008 | Ueno | G03G 15/757 399/167 |
| 2010/0054823 | A1 * | 3/2010 | Takasaka | F16D 1/10 399/286 |
| 2013/0078007 | A1 * | 3/2013 | Takami | G03G 21/181 399/284 |
| 2014/0270845 | A1 * | 9/2014 | Kawakami | G03G 21/186 399/110 |

FOREIGN PATENT DOCUMENTS

| | | | |
|---|---|---|---|
| CN | 101907858 | A | 12/2010 |
| JP | 2006154615 | A * | 6/2006 |
| WO | 2015067124 | A1 | 5/2015 |

* cited by examiner

*Primary Examiner* — Carla Therrien

(57) ABSTRACT

A drive gear for a generally cylindrical imaging component. The drive gear includes a body for engaging the generally cylindrical imaging component; a cylindrical shaft attached to the body, the cylindrical shaft having an end surface; and three prongs extending longitudinally outward from the end surface.

5 Claims, 6 Drawing Sheets

SHIPPING CAP FOR DRUM ASSEMBLY

The present application claims the benefit of U.S. Provisional Patent Application No. 62/269,354, entitled "Driveshaft Shipping Cap" and filed Dec. 18, 2015 which is incorporated by reference herein in its entirety.

BACKGROUND

The present invention generally relates to manufacturing, remanufacturing or repairing replaceable imaging components, and more particularly to apparatus and techniques for a shipping cap securing a dongle gear extending from the end of a drum or roller, such as an organic photo conductor (OPC) drum. The drum or roller may be used in a replaceable imaging cartridge adapted for holding marking material, such as toner.

In the imaging industry, there is a growing market for the remanufacture and refurbishing of various types of replaceable imaging cartridges such as toner cartridges, drum cartridges, inkjet cartridges, and the like. These imaging cartridges are used in imaging devices such as laser printers, xerographic copiers, inkjet printers, facsimile machines and the like, for example. Imaging cartridges, once spent, are unusable for their originally intended purpose. Without a refurbishing process these cartridges would simply be discarded, even though the cartridge itself may still have potential life. As a result, techniques have been developed specifically to address this issue. These processes may entail, for example, the disassembly of the various structures of the cartridge, replacing toner or ink, cleaning, adjusting or replacing any worn components and reassembling the imaging cartridge.

OPC drums may include a coated aluminum tube having hubs extending from each end of the tube. One hub may include a gear, such as a dongle gear, which extends from the end of the hub, engages with the printer and is driven by the printer to rotate the OPC drum and/or other combination of elements. Typically, the OPC drum is rotatably held in place by opposing plates or brackets. During the remanufacturing of a laser printer toner cartridge, the OPC drum may need to be replaced due to the wear or damage to the OPC drum. The replacement OPC drum assembly may include a replacement dongle gear attached to one end of the replacement OPC drum. The dongle gear may shift or pivot when the replacement OPC drum assembly is not installed in the cartridge. The present invention provides for a shipping cap which attaches to the end of the OPC drum assembly and maintains the correlation of the dongle with the OPC's geometric center line.

SUMMARY

In one aspect of the present invention, a drive gear assembly for use in an imaging cartridge comprises a generally cylindrical imaging component having a first axis of rotation; a gear hub attached to an end of the generally cylindrical imaging component; a dongle gear connected to the gear hub having a second axis of rotation, the dongle gear adapted to assume a first position in which the second axis of rotation is not aligned with the first axis of rotation, the dongle gear adapted to assume a second position in which the second axis of rotation is aligned with the first axis of rotation the drive gear; and a shipping cap secured to the drive gear assembly for maintaining the dongle gear in the second position.

A more complete understanding of the present invention, as well as further features and advantages of the invention, will be apparent from the following detailed description and the accompanying drawings.

DETAILED DESCRIPTION

The following detailed description of preferred embodiments refers to the accompanying drawings which illustrate specific embodiments of the invention. In the discussion that follows, specific systems and techniques for providing a shipping cap or lock for a drum or roller, such as an organic photo conductor (OPC) drum, for example, of a replaceable imaging cartridge adapted for holding marking material, are disclosed. Other embodiments having different structures and operations for the repair, remanufacture and operation of other types of replaceable imaging components and for various types of imaging devices, such as laser printers, inkjet printers, copiers, facsimile machines and the like, do not depart from the scope of the present invention.

Figure 1:
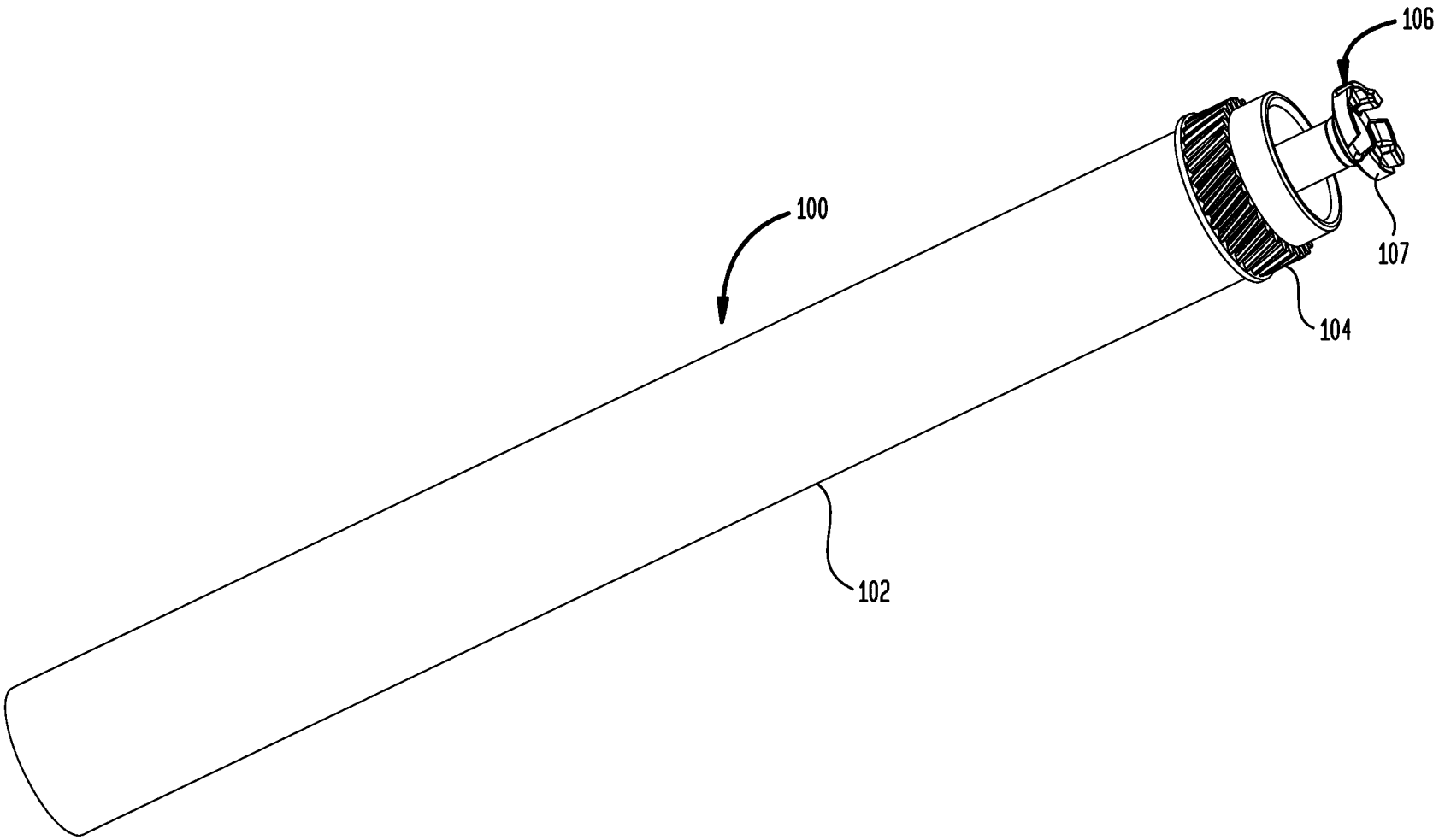
FIG. 1 shows a side view of a drum assembly in one aspect of the present invention.

FIG. 1 shows a side view of a drum assembly 100 in one aspect of the present invention. The drum assembly 100 may include a photoconductive drum 102, such as an OPC drum for example, comprising a coated cylindrical aluminum tube. A gear hub 104 extends from a first end of the drum 102. The gear hub 104 may include gear teeth. A dongle gear 106 having an outer rim 107 may extend from the gear hub 104 and engages with a printer which drives the rotation of the gear hub 104. The dongle gear 106 may pivot or slide such that the center axis of the dongle 106 is not aligned with the center axis of the drum 102 when the drum assembly is not installed in an imaging cartridge.

Figure 2:
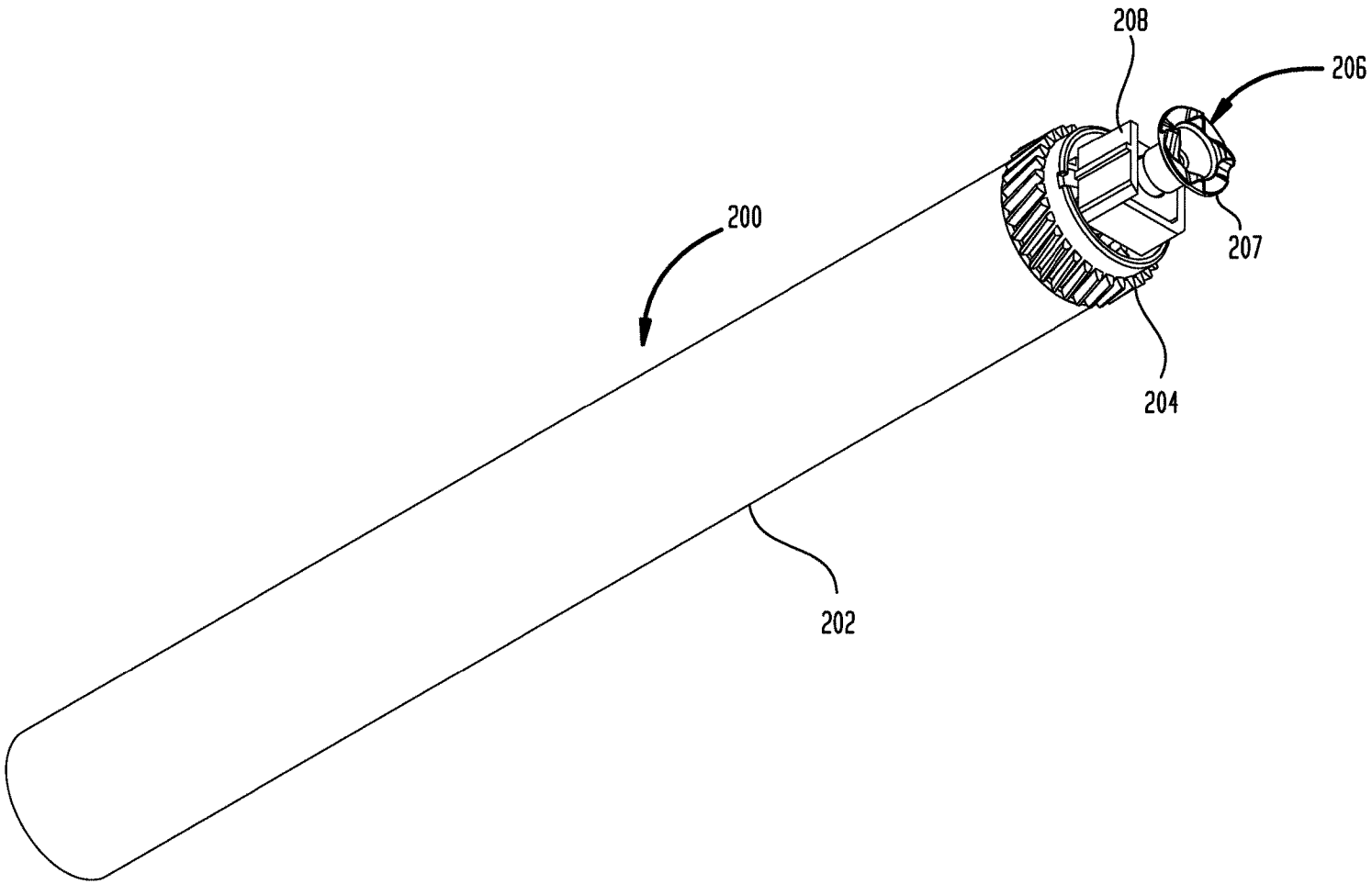
FIG. 2 shows a side view of a drum assembly in another aspect of the present invention.

FIG. 2 shows a side view of a drum assembly 200 in one aspect of the present invention. The drum assembly 200 may include a photoconductive drum 202, such as an OPC drum for example, comprising a coated cylindrical aluminum tube. A gear hub 204 extends from a first end of the drum 202. The gear hub 204 may include gear teeth. A dongle gear 206 having an outer rim 207 may extend from the gear hub 204 and engage with a printer which drives the rotation of the gear hub 204. A centering member 208 attached to a post of the dongle gear 206 may engage with the imaging cartridge when the dongle gear 206 is extended, keeping the axis of the dongle 206 aligned with the axis of the drum 202 when the drum assembly is installed in an imaging cartridge. The dongle gear 206 may pivot or slide such that the center axis of the dongle 206 is not aligned with the center axis of the drum 202 when the drum assembly is not installed in an imaging cartridge.

In one aspect, the present invention provides techniques for keeping the axis of a dongle gear, such as the dongle gear 106 or the dongle gear 206, for example, aligned with the axis of a roller or drum, such as the photoconductive drum 102 or the photoconductive drum 202, for example, when the dongle gear of a drum assembly, such as the drum assembly 100 or the drum assembly 200, for example, is not installed in an imaging cartridge.

Figure 3:
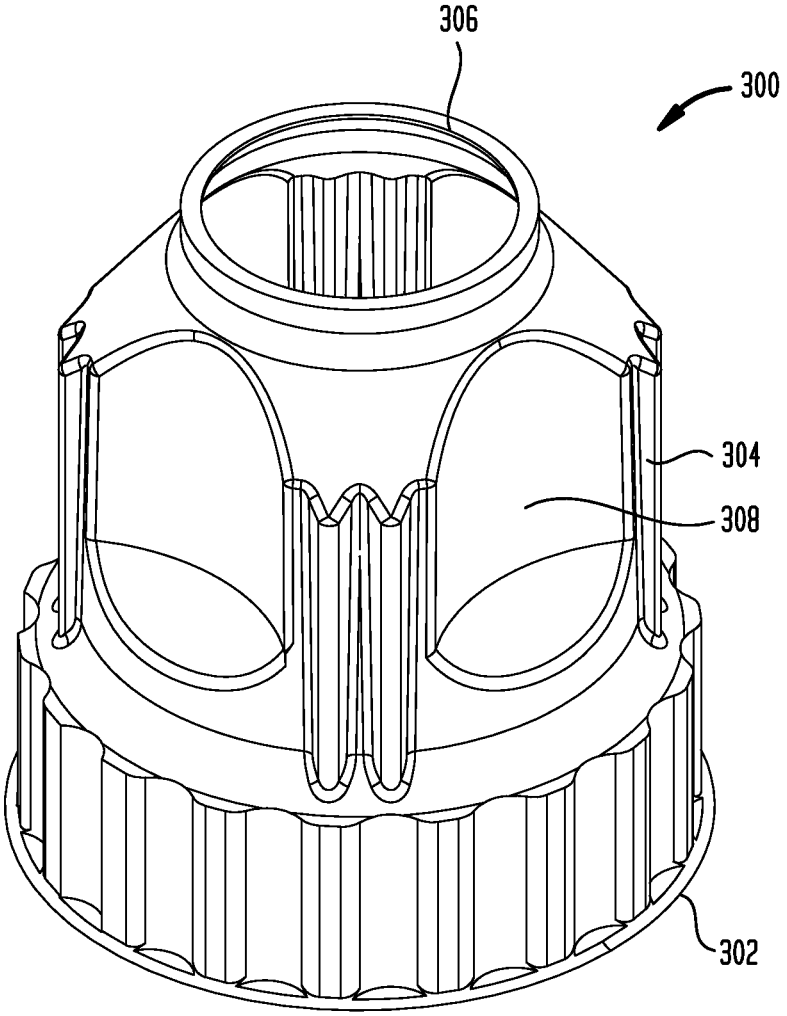
FIG. 3 shows a shipping cap for maintaining alignment of the dongle gear rotational axis and drum rotational axis when a drum assembly is not attached to an imaging cartridge.
Figure 4:
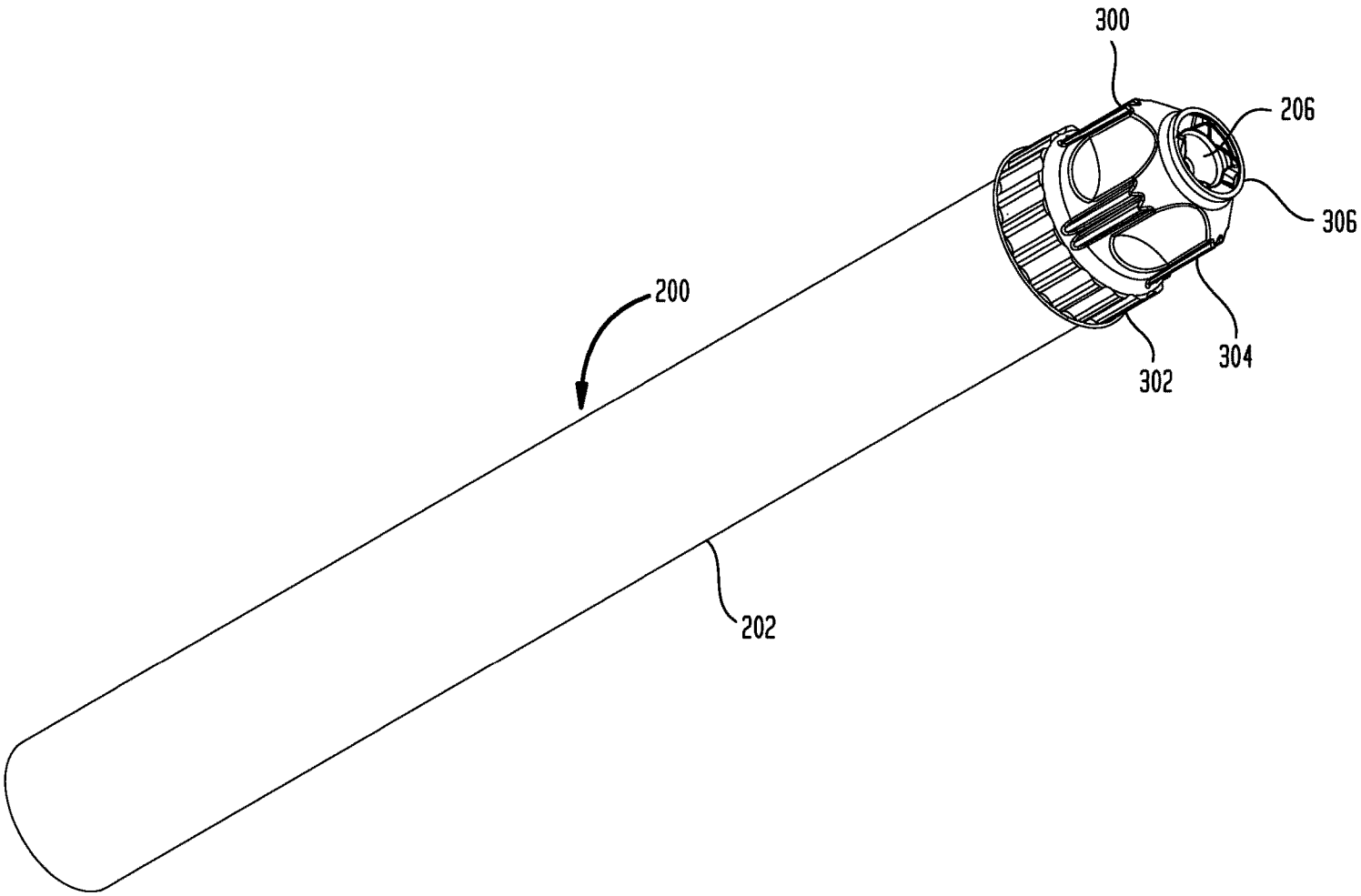
FIG. 4 shows a shipping cap attached to a drum assembly for maintaining alignment of the dongle gear rotational axis and drum rotational axis when the drum assembly is not attached to an imaging cartridge.

FIG. 3 shows a shipping cap 300 for maintaining alignment of the dongle gear axis and drum axis when the drum assembly is not attached to an imaging cartridge. The shipping cap 300 comprises a first end 302 connected through a body 304 to a second end 306. As shown in FIG. 4, when attached to the drum assembly 100 or 200, for example, the second end 306 of the shipping cap 300 holds the dongle gear 106 or 206 in place to ensure that the axis of the dongle gear 106 or 206 is aligned with the axis of the drum 102 or 202. The second end of the shipping cap 300 may be sized to friction fit with the rim 107 or 207 of the dongle gear 106 or 206. The first end 302 may physically engage with the flange 104 or 204 or other portion of the drum assembly 100 or 200 by, for example, being sized to friction fit with the drum flange 104 or 204, or may be engaged to the drum assembly 100 or 200 in another suitable manner. When secured to the drum assembly 100 or 200, the shipping cap 300 prevents the dongle gear 106 or 206 from shifting out of alignment with the axis of the drum 102 or 202. The shipping cap 300 may include indentations 308 to further secure the dongle gear 106 or 206 in place by contacting the centering member 208 of the drum assembly 200. FIG. 4 shows the shipping cap 300 attached to the drum assembly 200, but may be attached to the drum assembly 100 or other suitable drum assemblies.

Figure 5:
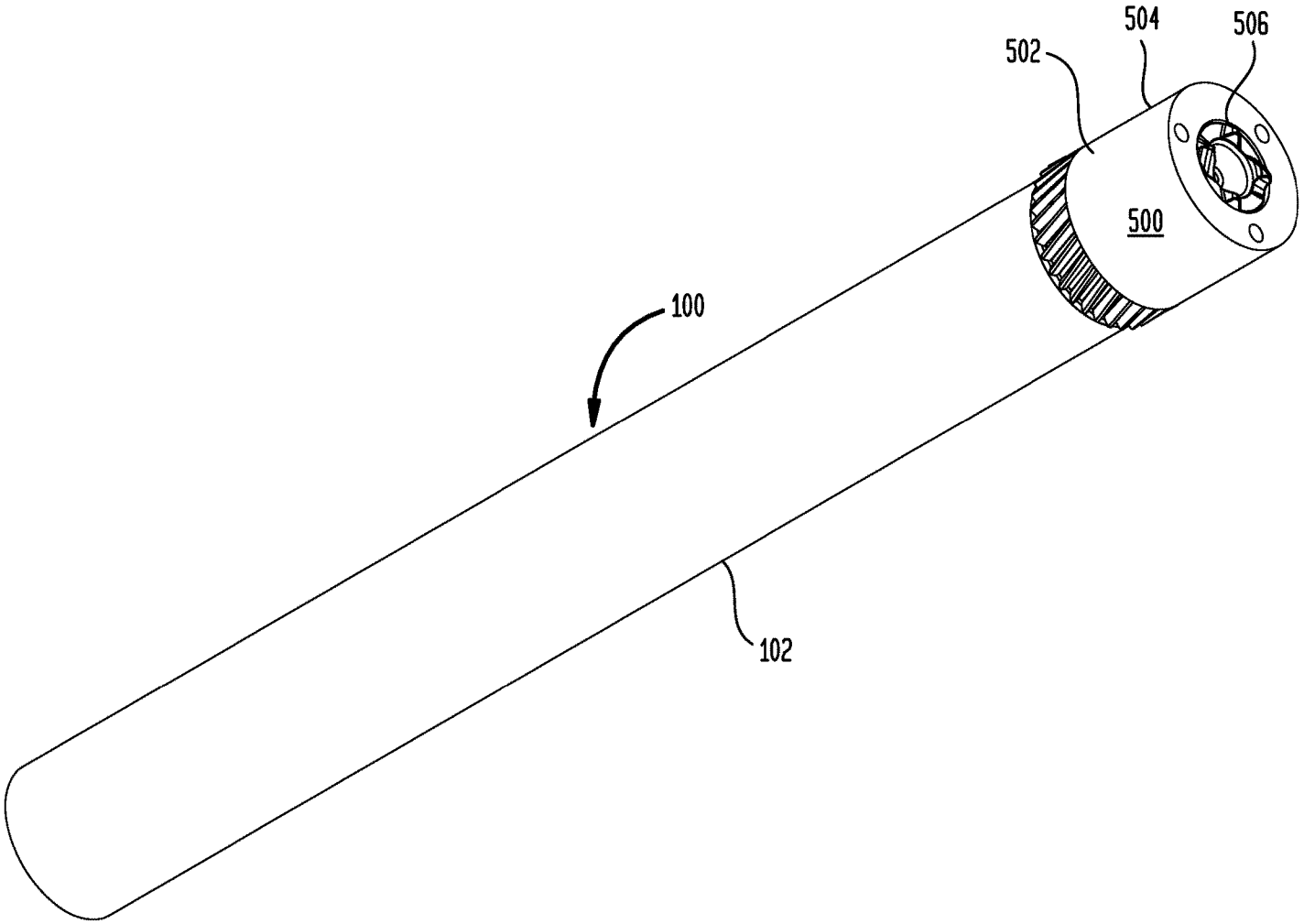
FIG. 5 shows a shipping cap attached to a drum assembly for maintaining alignment of the dongle gear rotational axis and drum rotational axis when the drum assembly is not attached to an imaging cartridge.

FIG. 5 shows a shipping cap 500 attached to a drum assembly 100 or 200 in accordance with another aspect of the present invention. The shipping cap 500 comprises a first end 502 connected through a body 504 to a second end 506. The shipping cap 500 functions in a similar manner to the shipping cap 300, but without the indentations 308.

Figure 6:
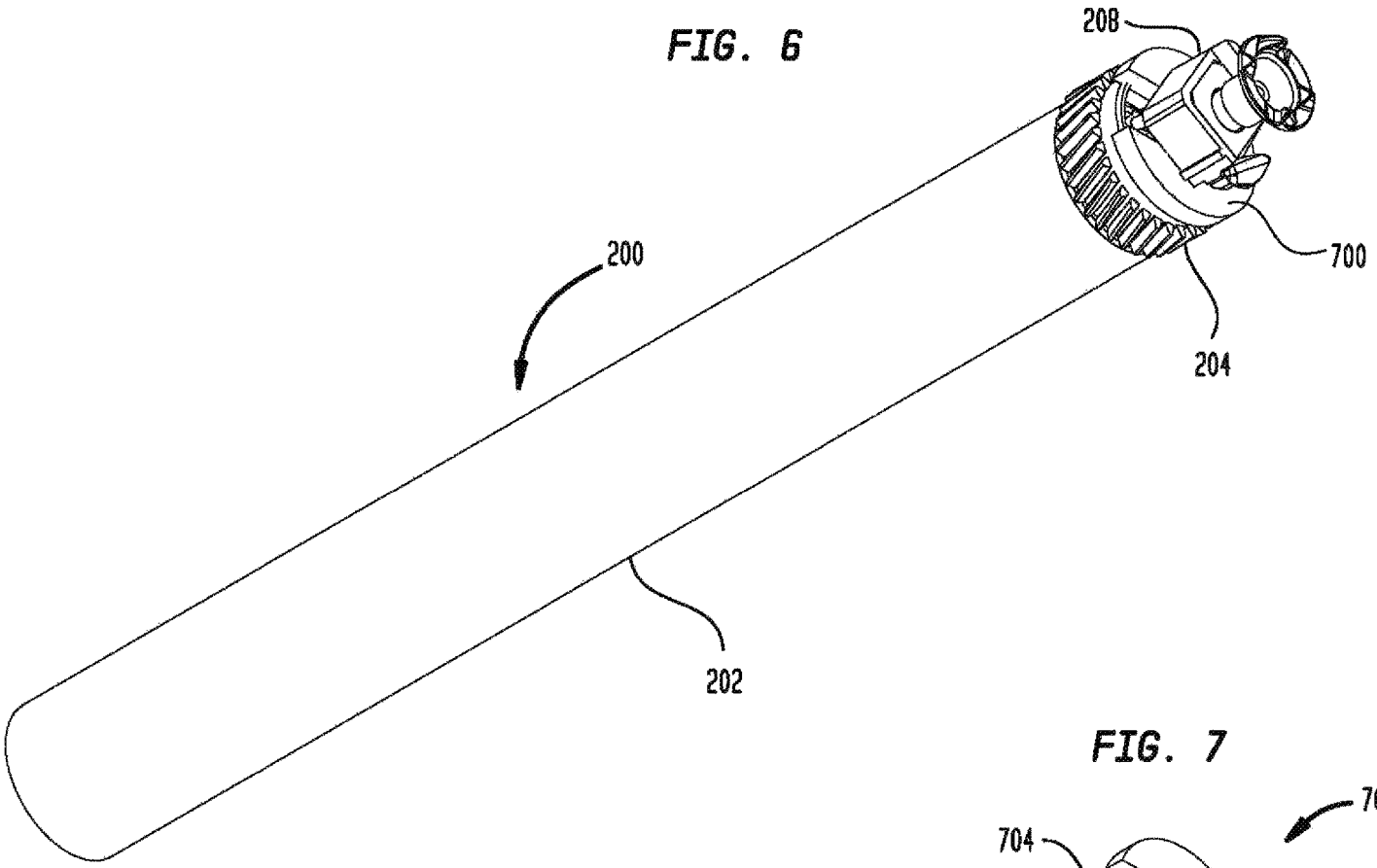
FIG. 6 shows a shipping lock secured to a drum assembly.
Figure 7:
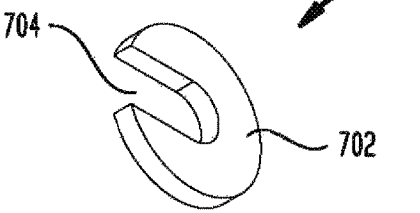
FIG. 7 shows the shipping lock attached to a drum assembly.

FIG. 7 shows a shipping lock 700 in accordance with another aspect of the present invention. The shipping lock 700 may comprise a generally flat body 702 with an opening 704. The body 702 may be generally disc-shaped. FIG. 6 shows the shipping lock 700 secured to the drum assembly 200 by placing the shipping lock 700 between the centering element 208 and the top of the drum flange 204. The thickness of the body 702 may be selected such a friction fit is formed when the shipping lock 700 is inserted between the centering member 208 and the top of the drum flange 204.

Although specific embodiments have been illustrated and described herein, those of ordinary skill in the art appreciate that any arrangement that is calculated to achieve the same purpose may be substituted for the specific embodiments shown and that the invention has other applications in other environments. This application is intended to cover any adaptations or variations of the present invention. The following claims are in no way intended to limit the scope of the invention to the specific embodiments described herein.

What is claimed is:

1. A drive gear assembly for use in an imaging cartridge comprising:

a generally cylindrical imaging component having a first axis of rotation;

a gear hub attached to an end of the generally cylindrical imaging component;

a dongle gear connected to the gear hub having a second axis of rotation, the dongle gear adapted to assume a first position in which the second axis of rotation is not aligned with the first axis of rotation, the dongle gear adapted to assume a second position in which the second axis of rotation is aligned with the first axis of rotation; and a shipping cap secured to the drive gear assembly for maintaining the dongle gear in the second position.

2. The drive gear assembly of claim 1 wherein the shipping cap comprises a first end connected through a body to a second end.

3. The drive gear assembly of claim 2 wherein the second end of the shipping cap holds the dongle gear in place.

4. The drive gear assembly of claim 3 wherein the first end of the shipping cap is secured to the drum assembly.

5. A drive gear assembly for use in an imaging cartridge comprising:

a generally cylindrical imaging component having a first axis of rotation;

a gear hub attached to an end of the generally cylindrical imaging component;

a dongle gear connected to the gear hub having a second axis of rotation, the dongle gear adapted to assume a first position in which the second axis of rotation is not aligned with the first axis of rotation, the dongle gear adapted to assume a second position in which the second axis of rotation is aligned with the first axis of rotation;

a centering member connected to the dongle gear; and a shipping lock disposed between the centering member and the gear hub for maintaining the dongle gear in the second position.

* * * * *